US009038300B2

(12) United States Patent
Theisen et al.

(10) Patent No.: US 9,038,300 B2
(45) Date of Patent: May 26, 2015

(54) SHELF LABEL HOLDER

(71) Applicant: Target Brands, Inc., Minneapolis, MN (US)

(72) Inventors: Jennifer A. Theisen, Crystal, MN (US); Erin L. Zobel, Minneapolis, MN (US); William Y. Stafford, Minnetrista, MN (US); Robert M. Gray, Oceanside, NY (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 14/021,217

(22) Filed: Sep. 9, 2013

(65) Prior Publication Data

US 2015/0068086 A1 Mar. 12, 2015

(51) Int. Cl.
*G09F 3/18* (2006.01)
*G09F 3/20* (2006.01)

(52) U.S. Cl.
CPC ..... *G09F 3/201* (2013.01)

(58) Field of Classification Search
CPC ..... A47F 1/06; A47F 5/02; A47F 7/146; G09F 3/00
USPC ..... 40/661.03, 661.05
See application file for complete search history.

(56) References Cited

U.S. PATENT DOCUMENTS

| | | | | |
|---|---|---|---|---|
| 1,893,594 | A | 1/1933 | Oestreich | |
| 2,564,517 | A | 8/1951 | Beals | |
| D275,867 | S | 10/1984 | Lazzara et al. | |
| 4,556,183 | A | 12/1985 | Greenberger | |
| D298,553 | S | 11/1988 | Zobitz | |
| D328,473 | S | 8/1992 | Mayden | |
| 5,488,793 | A * | 2/1996 | Gebka et al. | 40/661.03 |
| 6,105,295 | A | 8/2000 | Brinkman et al. | |
| 6,145,232 | A | 11/2000 | Bevins | |
| 6,266,906 | B1 * | 7/2001 | Nagel | 40/661.03 |
| 6,470,613 | B1 | 10/2002 | Wildrick | |
| 6,523,291 | B2 * | 2/2003 | Nagel | 40/661 |
| 6,823,620 | B2 * | 11/2004 | Nagel | 40/661.07 |
| 6,868,629 | B2 * | 3/2005 | Fast et al. | 40/661.03 |
| 6,898,885 | B1 * | 5/2005 | Nagel | 40/661.06 |
| 6,932,226 | B2 | 8/2005 | Hardy | |
| D510,602 | S | 10/2005 | Wasilko | |
| 7,325,348 | B2 * | 2/2008 | Mueller et al. | 40/649 |
| 7,340,855 | B2 | 3/2008 | Wiltfang et al. | |
| D569,916 | S | 5/2008 | Garfinkle | |
| 7,386,950 | B2 * | 6/2008 | Fast et al. | 40/661.03 |
| D573,657 | S | 7/2008 | Caterinacci | |
| D579,984 | S | 11/2008 | Bruegmann et al. | |
| 7,627,971 | B2 | 12/2009 | Fast | |
| 8,613,156 | B2 * | 12/2013 | Nunez et al. | 40/661.08 |
| 2007/0266604 | A1 | 11/2007 | Garfinkle | |
| 2012/0110883 | A1 | 5/2012 | White et al. | |

OTHER PUBLICATIONS

Office Action from Canadian Patent Application No. 2,842,974, mailed May 12, 2014 (2 pages).
Pending U.S. Appl. No. 13/893,636, filed May 14, 2013, entitled Shelf Label Holder, 18 pages.

* cited by examiner

*Primary Examiner* — Shin Kim
(74) *Attorney, Agent, or Firm* — Leanne Taveggia Farrell; Westman, Champlin & Koehler, P.A.

(57) ABSTRACT

A label holder includes a base, a sign sleeve for receiving at least one printed price label and a living hinge coupling the base to the sign sleeve. The sign sleeve is defined by a main panel that is substantially planar and a return flange that is coupled to the main panel at a joined end. The return flange extends upward from the joined end and terminates at an end located along the main panel.

20 Claims, 5 Drawing Sheets

SHELF LABEL HOLDER

BACKGROUND

Businesses use a variety of types of display structures to present products and related information to customers for purchase. These display structures support both the product and shelf-type price label holders that receive printed material indicating the product price. An example display structure includes shelf-type structures having shelf-type price label holders.

The discussion above is merely provided for general background information and is not intended to be used as an aid in determining the scope of the claimed subject matter.

SUMMARY

A label holder includes a base, a sign sleeve for receiving at least one printed price label and a living hinge coupling the base to the sign sleeve. The sign sleeve is defined by a main panel that is substantially planar and a return flange that is coupled to the main panel at a joined end. The return flange extends upward from the joined end and terminates at an end located along the main panel.

A shelf assembly includes a first shelf label holder coupled to a shelf-type display structure and including a pocket for receiving at least one first printed sign. The shelf assembly also includes a second shelf label holder insertably held within the pocket of the first shelf label holder. The second shelf label holder includes a rigid base, a pocket having a rigid portion coupled to a flexible flap at a joined bottom end and a flexure connecting the rigid base to the pocket of the second shelf label holder. The rigid base of the second shelf label holder is held in the pocket of the first shelf label holder behind the at least one first printed sign.

A method of altering a shelf-type display structure includes providing a first shelf label holder having a pocket that retains at least one first printed sign that is coupled to a shelf-type display structure and inserting a rigid base of a second shelf label holder into the pocket of the first shelf label holder. The second shelf label holder includes a sign sleeve coupled to the rigid base by a flexure. The sign sleeve is defined by a rigid main panel and a flexible flap joined to the substantially planar rigid main panel by a joined bottom end.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

In a business, such as a retail business, certain areas in a store display products on shelf-type display structures that include shelf label holders for holding small-sized labels. For example, in a beauty department, a shelf-type display structure may display many different types of beauty products on the same shelf or many of the same beauty products on the same shelf that are differentiated only by color. Since each beauty product including each color of the same beauty products requires their own label, small-sized labels are preferred to not detract from the product being displayed. However, in some jurisdictions, these small-sized labels do not satisfy certain consumer label size requirements.

As will be described in detail below, a shelf label holder is engaged with an existing shelf label holder in an area of a business where larger-sized labels are needed. The engagement of the shelf label holder with the existing shelf label holder modifies or alters the existing shelf label holder so that larger-sized labels that meet consumer label size requirements are displayed. The shelf label holder includes a base for engagement with the existing shelf label holder, a pocket or sign sleeve for receiving at least one printed price label and a hinge or flexure that couples the base to the pocket or sign sleeve.

Figure 1:
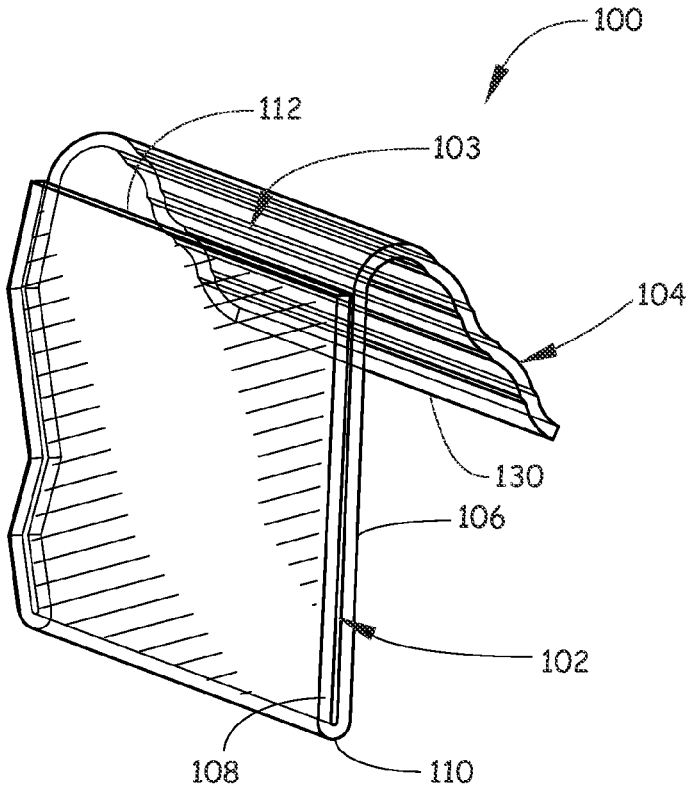
FIG. 1 is a perspective view of a portion of a shelf label holder according to one embodiment.

FIG. 1 is a perspective view of a portion of a shelf label holder 100 according to one embodiment. A front view, a back view, a left side view (a right side view being a mirror image), an enlarged left side view, a top view and a bottom view of the portion of the shelf label holder 100 are illustrated in FIGS. 2-7, respectfully. In one embodiment, shelf label holder 100 is integrally formed or made from a single, continuous material, such as by extruding or plastic injection molding a polymer or plastic, and includes a pocket or sign sleeve 102 for receiving at least one printed price label, a base 104 for engaging with an existing shelf label holder and a hinge or flexure 103 coupling the pocket or sign sleeve 102 to the base 104. Although shelf label holder 100 can be made from a single, continuous material, it is possible for different components of shelf label holder 100 to vary in opacity or transparency. In the embodiment illustrated in FIGS. 1-7, the entirety of shelf label holder 100 is made with a transparent polymer or plastic. Therefore, in the FIG. 1 perspective view and in the FIG. 4 side view and FIG. 5 enlarged side view, all structural lines are illustrated including structural lines that can be seen through shelf label holder 100. However, in the FIG. 2 front view, the FIG. 3 back view, the FIG. 5 top view and the FIG. 6 bottom view, the see through structural lines are omitted for purposes of clarity.

Shelf label holder 100 can have a variety of different lengths depending on how shelf label holder 100 is to be used. For example, shelf label holder 100 can be two or three inches in length in situations where only a single, small-sized printed label resides in an existing shelf label holder and needs to be covered to meet consumer label size requirements. In another example, shelf label holder 100 can be one, two, three or four feet in length, for example, in situations where multiple small-sized printed labels reside in an existing shelf label holder and need to be covered to meet consumer label size requirements.

Figure 4:
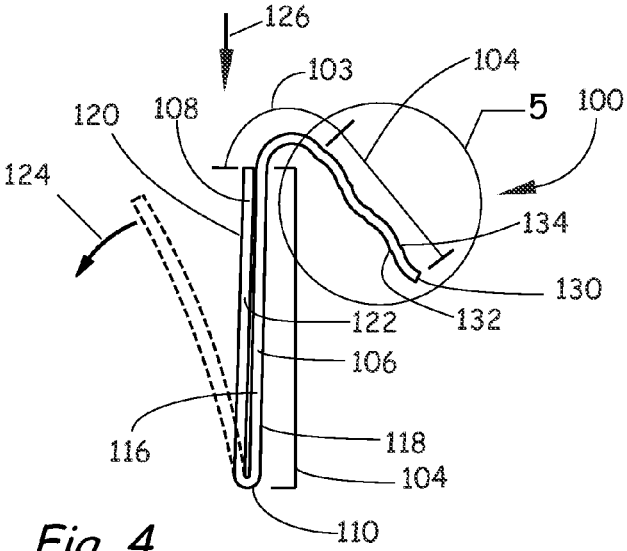
FIG. 4 is a side view of the portion of the shelf label holder illustrated in FIG. 1.
Figure 5:
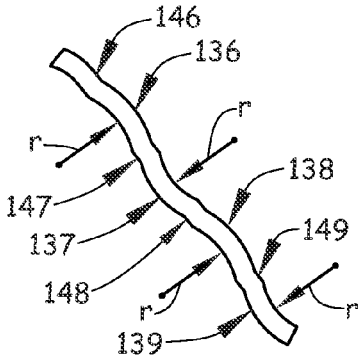
FIG. 5 is an enlarged side view of the base of the shelf label holder as denoted in FIG. 4.
Figure 6:
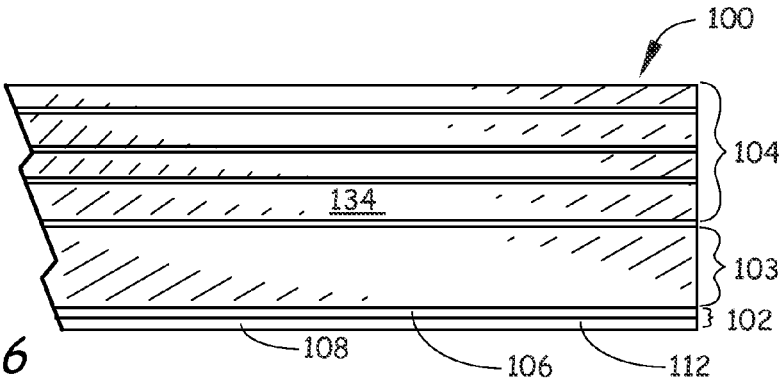
FIG. 6 is a top view of the portion of the shelf label holder illustrated in FIG. 1.
Figure 7:
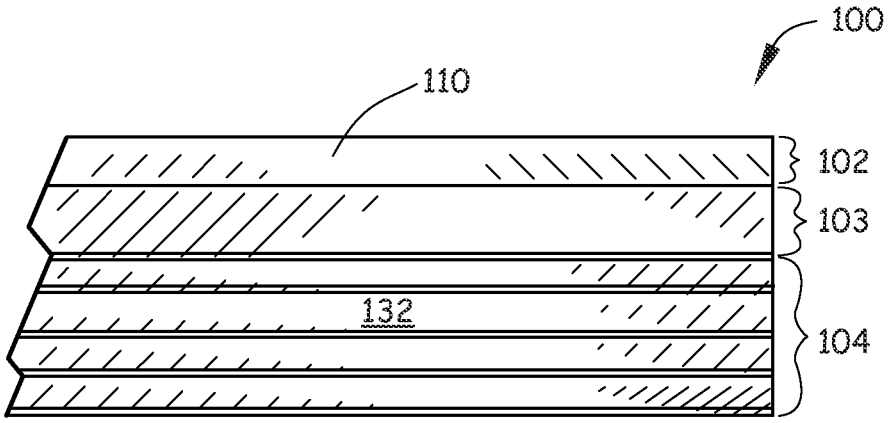
FIG. 7 is a bottom view of the portion of the shelf label holder illustrated in FIG. 1.

As illustrated in FIGS. 1-7, sign sleeve 102 of shelf label holder 100 includes a main panel or rigid portion 106 and a return flange or flexible flap 108 that is coupled to main panel 106 at a joined end 110. At least return flange or flexible flap 108 of sign sleeve 102 is made of a transparent polymer or plastic such that the printed price label that is received by sign sleeve 102 can be clearly viewed. In another embodiment, both main panel 106 and return flange 108 can be made of a transparent polymer or plastic as illustrated in the FIG. 1 perspective view. Main panel 106 is substantially planar as illustrated in FIG. 4 and includes a front surface 116 and a back surface 118 opposite front surface 116. Return flange or flexible flap 108 includes a front surface 120 and a back surface 122 opposite front surface 120. Return flange 108 extends from joined end 110 in a generally up-turned or upward manner and terminates at an end 112 located along main panel 106 at a height 109 (FIG. 2) relative to a bottom of joined end 110. Height 109 is substantially the same as a height of main panel or rigid portion 106.

Figure 2:
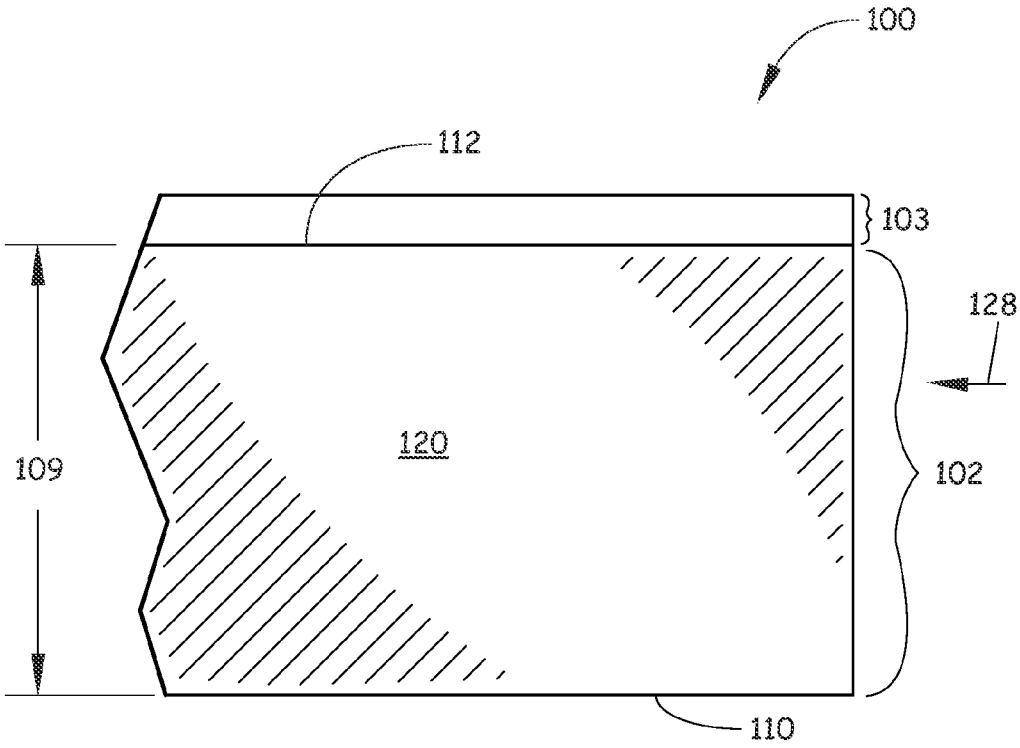
FIG. 2 is a front view of the portion of the shelf label holder illustrated in FIG. 1.
Figure 3:
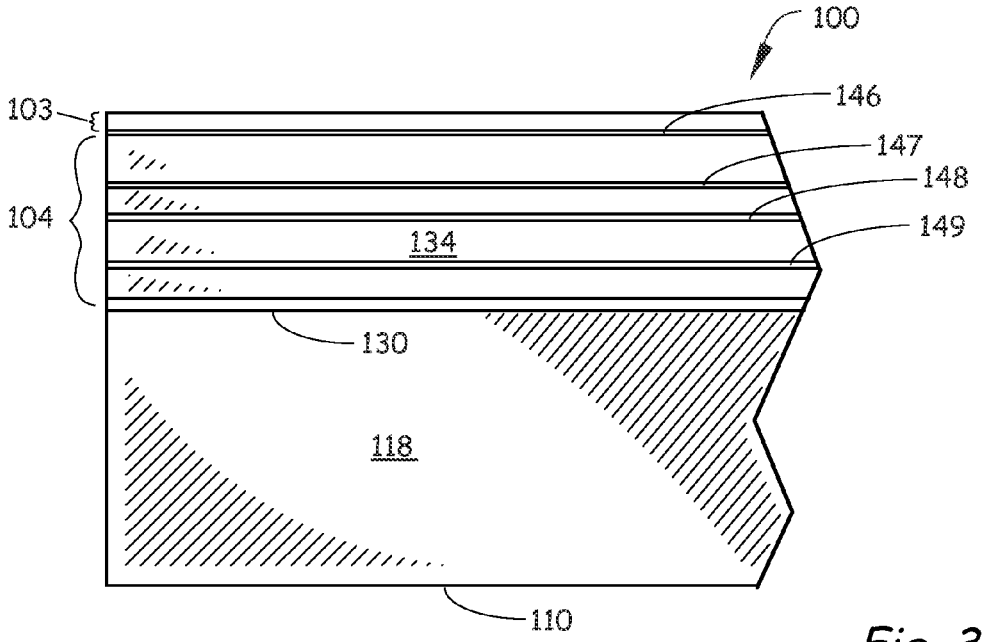
FIG. 3 is a back view of the portion of the shelf label holder illustrated in FIG. 1.

In one embodiment, return flange 108 is substantially flexible and is biased towards main panel or rigid portion 106. More specifically, return flange 108 is biased such that back surface 122 of return flange 108 is biased to interact with or contact a portion of front surface 116 of main panel 106. The flexible nature of return flange 108 allows return flange 108 to be rotated about joined end 110 as indicated by arrow 124 (FIG. 4). Rotation of return flange 108 allows at least one printed price label to be placed between return flange 108 and main panel 106 and into sign sleeve or pocket 102 in a top-down manner as indicated by arrow 126 (FIG. 4). In an alternative embodiment, at least one printed price label can be placed between return flange 108 and main panel 106 in a side manner as indicated by arrow 128 (FIG. 2). In one embodiment, the printed price label(s) placed in sign sleeve 102 can be a thin gauge printed sheet material, such as paper, cardstock, paper board, etc., printed with textual and/or graphical indicia including information relating to a number of particular items being displayed on the shelf to which shelf label holder 100 is attached. In particular, indicia printed on the price label(s) can indicate product type, department, sale status, supply availability, item price, item name and a bar code or other scannable portion that can be scanned through front 120 of return flange 108 and being related to the goods displayed on the shelf behind each price label.

Base 104 extends from hinge or flexure 103 and, like main panel 106, is rigid. Base 104 terminates at end 130 and includes a front surface 132 and a back surface 134. Extending between hinge or flexure 103 and end 130, the rigid material of base 104 is wavy. Although the rigid material of base 104 does not make abrupt changes between frontward and backward directions to form its wavy shape, the rigid material of base 104 makes changes between frontward and backward directions by including a first arcuate bend 136 having a radius of curvature r that is concave relative to front surface 132, a second arcuate bend 137 having a radius or curvature r that is convex relative to front surface 132 and is connected to the first arcuate bend 136, a third arcuate bend 138 having a radius of curvature r that is concave relative to front surface 132 and is connected to the second arcuate bend 137 and a fourth arcuate bend 139 having a radius of curvature r that is convex relative to front surface 132 and is connected to the third arcuate bend 138. First arcuate bend 136, second arcuate bend 137, third arcuate bend 138 and fourth arcuate bend 139 each include radii of curvature r, which are all substantially the same.

In one embodiment, arcuate bend 136 can be directly coupled to arcuate bend 137, arcuate bend 138 can be directly coupled to arcuate bend 137 and arcuate bend 139 can be directly coupled to arcuate bend 138 so that the change in direction of arcuate bends occurs at a single point. In other embodiments, however, and in the embodiment illustrated in FIGS. 1-7, arcuate bends are not directly linked. Rather, between each arcuate bend is a planar portion. For example, between hinge or flexure 103 and arcuate bend 136 is a planar portion 146, between arcuate bend 136 and arcuate bend 137 is a planar portion 147, between arcuate bend 137 and arcuate bend 138 is a planar portion 148 and between arcuate bend 138 and arcuate bend 139 is a planar portion 149. Such planar portions 146, 147, 148 and 149 are clearly illustrated in the enlarged side view of FIG. 5. Arcuate bends 136, 137, 138 and 139 or arcuate bends 136, 137, 138 and 139 in combination with planar portions 146, 147, 148 and 149 provide base 104 with a versatile structure for being retained within a pocket of an existing shelf label holder without falling out. For example, wavy base 104 can be inserted into a pocket of an existing shelf label holder that is rigid without needing anything further to keep base 104 in place. Such an example will be illustrated and described in detail below. In another example, wavy base 104 can be retained within a pocket of an existing shelf label holder that includes a return flange or flexible flap that is biased against a more rigid panel.

Hinge or flexure 103 couples pocket or sign sleeve 102 to base 104. In one embodiment, hinge or flexure 103 is a living hinge, which is made from the same material or as the same entity as the two rigid pieces it connects and in one embodiment is thinned or cut to allow the two rigid pieces to be flexibly rotated relative to each other. For example, main panel 106 of sign sleeve 102 and base 104 are made rigid, while hinge or flexure 103 is made flexible. In this way, when base 104 is inserted into a pocket of an existing shelf label holder, hinge or flexure 103 allows sign sleeve 102 to be rotated about base 104 or about the pocket of the existing shelf label holder to which base 104 is inserted.

A living hinge is a term of art that defines a thin flexible hinge made usually from plastic, as opposed to cloth, leather, or some other substance, that joins two rigid plastic parts together. The living hinge allows the rigid plastic parts to bend relative to each other along the living hinge. Typically, living hinges are manufactured in an injection molding process that creates all three parts at one time as a single entity. The living hinge is thinned to allow for movement. Polyethylene and polypropylene are two exemplary resins for living hinges and include characteristics of excellent fatigue resistance, low cost and ease of manufacturing.

Figure 9:
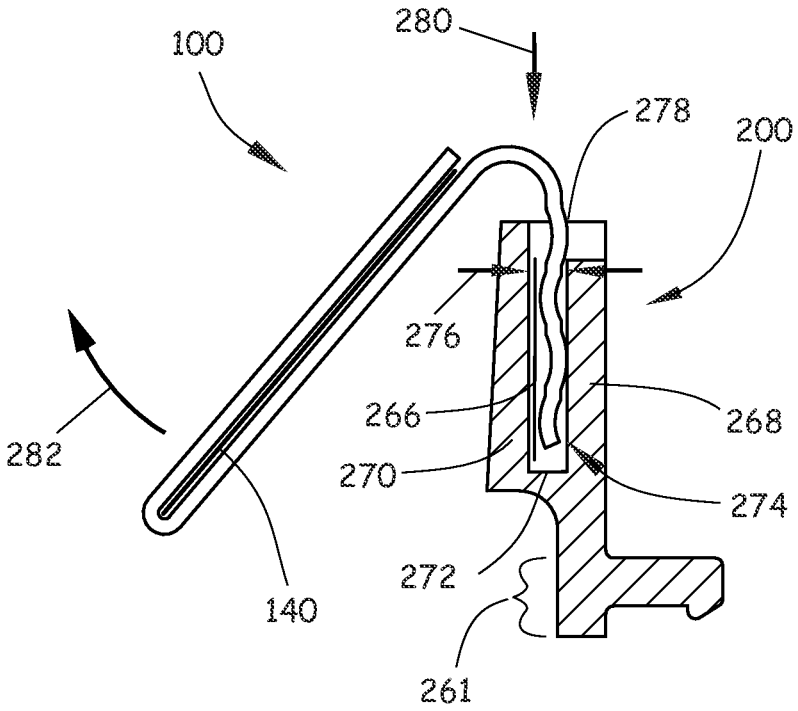
FIG. 9 is an enlarged section view of the shelf assembly illustrated in FIG. 8.
Figure 8:
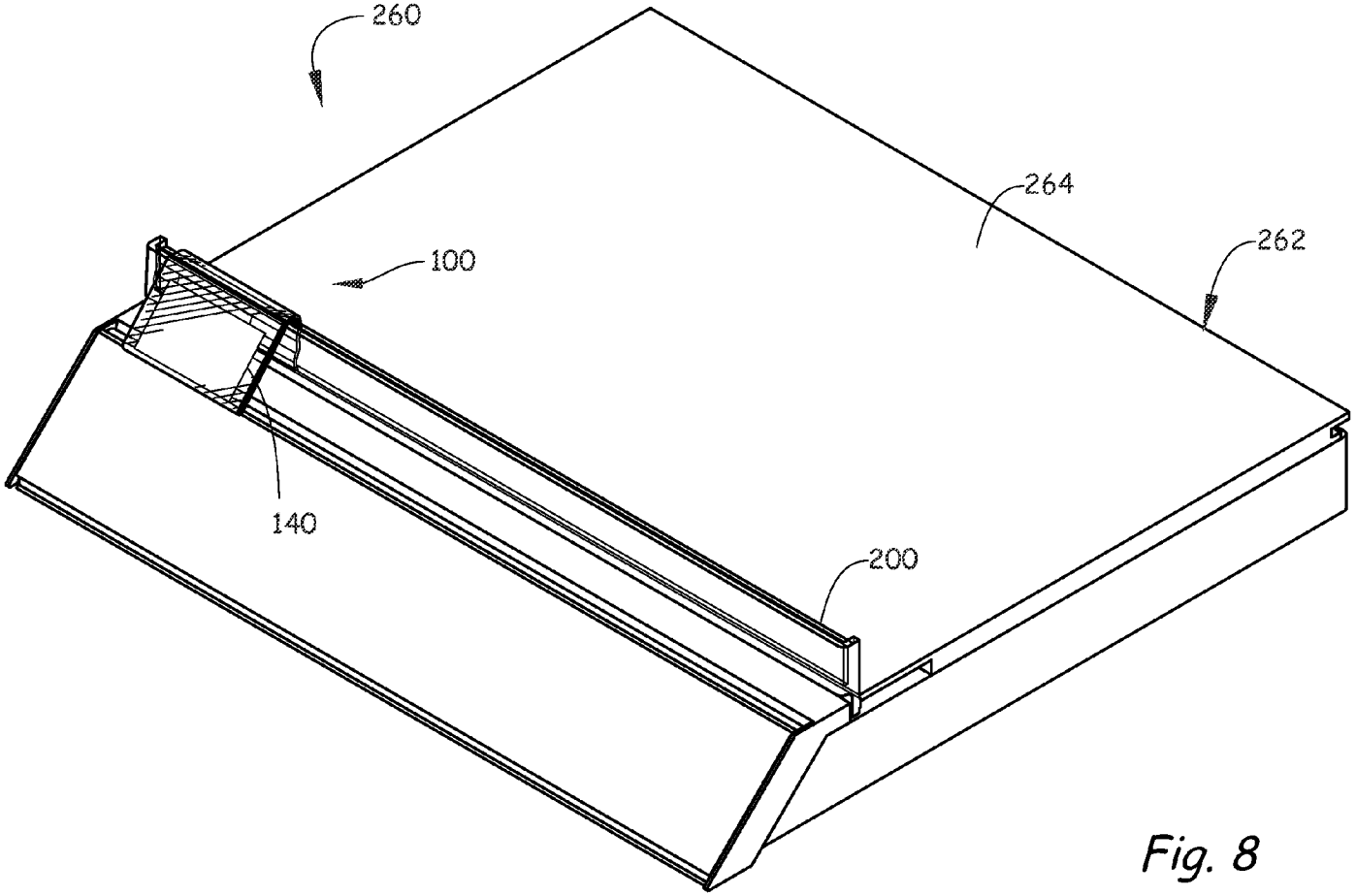
FIG. 8 is a perspective view of a shelf assembly including the shelf label holder illustrated in FIGS. 1-7 assembled to an existing shelf label holder located on a shelf-type display structure according to one embodiment.

FIG. 8 illustrates a perspective view of an exemplary shelf assembly 260 including the entirety of shelf label holder 100 illustrated in FIGS. 1-7 including a price label 140, a shelf-type display structure 262 and an existing shelf label holder 200 according to one embodiment. FIG. 9 is an enlarged section view of shelf label holder 100 assembled to existing shelf label holder 200. Shelf-type display structure 262 is configured to hold and support a plurality of goods or products (not illustrated) that are being offered for sale. More particularly, shelf-type display structure 262 includes a shelf 264 for holding the plurality of goods or products and existing shelf label holder 200 that holds smaller-sized printed price label(s) 266 (FIG. 9) having a size that is less than a size of the printed price label 140 being held by shelf label holder 100. It should be realized that shelf-type display structure 262 is one type of shelf-type display structure that uses an existing shelf label holder 200 that holds at least one small-sized printed price label 266. However, other types of shelf-type display structures that hold at least one small-sized printed price label are possible.

In FIGS. 8 and 9, existing shelf label holder 200 includes a fastening section 261 that is fastened to a front of shelf 264 of shelf-type display structure 262 and, in one embodiment, can be formed of a polymer, such as transparent plastic. As illustrated in FIG. 9, existing shelf label holder 200 is an example of a shelf label holder that is substantially completely rigid. More particularly, shelf label holder 200 includes a rigid back component 268 connected to a rigid front component 270 by a rigid bottom connecting piece 272 to define a sign sleeve or pocket 274. Back component 268, front component 270 and bottom connecting piece 272 (and therefore also sign sleeve or pocket 274) extend almost the entire width of shelf 264. Bottom connecting piece 272 encloses the bottom of sign sleeve or pocket 274 of existing shelf label holder 200, while a distance 276 between back component 268 and front component 270 of sign sleeve or pocket 274 provides an open top 278. As previously discussed, it should be realized that the pocket of an existing shelf label holder can be other than completely rigid. For example, the pocket of an existing shelf holder can include a return flange or flexible flap that is biased against a more rigid panel.

As clearly illustrated in FIG. 9, existing shelf label holder 200 receives printed price label(s) 266 through open top 278. More specifically, printed price label(s) 266 are inserted into pocket 274 of existing shelf label holder 200 in a top-down manner as indicated by arrow 280. Likewise, existing shelf label holder 200 receives base 104 of shelf label holder 100 through open top 278. More specifically, base 104 of shelf label holder 100 is inserted into pocket 274 of existing shelf label holder 200 in a top-down manner as indicated by arrow 280. As illustrated in FIG. 8, the length of the shelf label holder 100 used is about two to three inches in length in order to cover only the single small-sized printed price label 266 that resides in existing shelf label holder 200. However, a shelf label holder 100 having a greater length can be used when multiple small-sized printed price labels 266 that reside in the same existing shelf label holder need to be covered. For example, if existing shelf label holder 200 included multiple printed price labels 266 that were spaced apart from each other, either multiple shelf label holders 100 could be inserted into existing shelf label holder 200 to cover each of the multiple printed price labels 266 or a single longer length shelf label holder 100 could be inserted into existing shelf label holder 200 to cover each of the multiple printed price labels 266. In accordance with some embodiments, shelf label holder 100 has a length of substantially 36 inches or 48 inches, for example.

Figure 10:
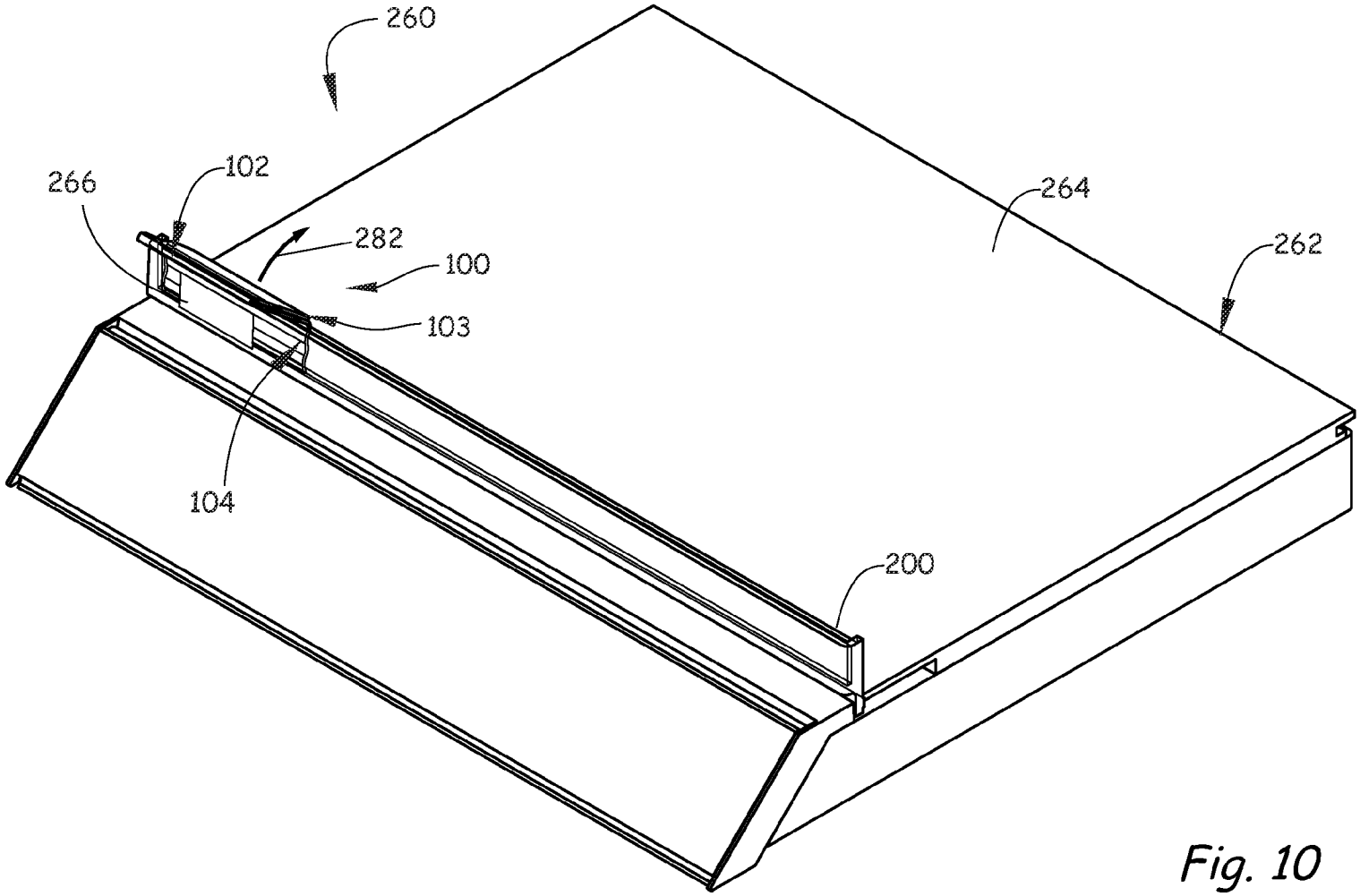
FIG. 10 is a perspective view of the pocket of the shelf label holder of FIG. 8 being rotated about its base using its hinge.

As further illustrated in FIG. 9, base 104 is inserted into and held in sign sleeve or pocket 274 of existing shelf label holder 200 such that base 104 is located behind printed price label(s) 266. In this way and as illustrated in the perspective view of exemplary shelf assembly 262 in FIG. 10, when hinge or flexure 103 allows pocket or sign sleeve 102 to be rotated in a direction 282 about base 104, printed price label(s) 266 located in sign sleeve or pocket 274 of existing shelf label holder 200 can be accessed for viewing or for bar code scanning. One exemplary situation where accessing printed price label(s) 266 under shelf label holder 100 might occur are when store employees need to or are gathering information related to inventory of the products being displayed on shelf 264.

A method of altering shelf-type display structure 262 will now be described. The method includes providing first shelf label holder 200 coupled to shelf-type display structure 262. As previously described first shelf label holder 200 includes pocket 274 that retains at least one first printed sign 266. As also previously described, the method further includes base 104 of second shelf label holder 100 being inserted into pocket 274 of first shelf label holder 200 to be held in place.

Furthermore, at least one second printed sign 140 is inserted into pocket or sign sleeve 102 of second shelf label holder 100. As previously described, second printed sign 140 has a size that is greater than a size of first printed sign 266. In one embodiment, second printed sign 140 is inserted into pocket or sign sleeve 102 before base 104 of second shelf label holder 100 is inserted into pocket 274 of first shelf label holder 200. In the alternative, second printed sign 140 can be inserted into pocket or sign sleeve 102 after base 104 of second shelf label holder 100 is inserted into pocket 274 of first shelf label holder 200. With reference back to FIG. 4, return flange or flexible flap 108 is rotated about joined bottom end 110 in direction 124 to insert at least one second printed sign 140 between main panel 106 and return flange 108 of pocket or sign sleeve 102 of shelf label holder 100. At least one second printed sign 140 can be inserted from the side or from top-down. In this way, second shelf label holder 100 modifies the size of printed price labels that are located in first shelf label holder 200 and presented to the customer when shelf-type display structure 262 is used.

Still further, when inserting base 104 of second shelf label holder 100 into pocket 274 of first shelf label holder 200, base 104 is inserted behind the printed price label(s) 266 that are held in pocket 274. In this way, while second shelf label holder 100 covers first printed price label(s) 266 after being inserted into pocket 274 because second printed price label(s) 140 hide first printed price label(s) 266 from view, first printed price label(s) 266 can still be accessed for viewing or for bar code scanning by rotating pocket or sign sleeve 102 of second shelf label holder 100 about base 104 of second shelf label holder 100 using hinge or flexure 103.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A shelf assembly comprising:

a first shelf label holder including a fastening section that fastens to a front of a shelf and a transparent pocket for receiving at least one first printed sign, wherein the pocket includes a front, a back, a bottom and an open top and wherein the bottom of the pocket is located above the fastening section of the first shelf label holder and above the shelf; and a second shelf label holder including a rigid base, a sign sleeve and a flexure connecting the rigid base to the sign sleeve; and wherein the rigid base of the second shelf label holder is inserted through the open top of the pocket and held in the pocket of the first shelf label holder behind the at least one first printed sign.

2. The shelf assembly of claim 1, wherein the sleeve of the second shelf label holder is configured to receive at least one second printed sign that has a size that is greater than the at least one first printed sign located in the pocket of the first shelf label holder.

3. The shelf assembly of claim 1, wherein the sleeve of the second shelf label holder comprises a rigid portion coupled to a flexible flap at a joined bottom, the rigid portion of the sleeve of the second shelf label holder is substantially planar and is rotatable about the rigid base of the second shelf label holder using the flexure.

4. The shelf assembly of claim 1, wherein the rigid base extends from the flexure, terminates at an end and comprises a wavy shape.

5. The shelf assembly of claim 4, wherein the rigid base comprises a first arcuate bend that is concave relative to a front surface of the rigid base and a second arcuate bend connected to the first arcuate bend that is convex relative to the front surface of the rigid base.

6. The shelf assembly of claim 5, wherein the rigid base further comprises a third arcuate bend connected to the second arcuate bend that is concave relative to the front surface of the rigid base and a fourth arcuate bend connected to the third arcuate bend that is convex relative to the front surface of the rigid base.

7. A method comprising:

providing a first shelf label holder fastened to a front of a shelf and including a transparent pocket having a front, a back, a bottom and an open top through which the pocket receives at least one first printed sign that is retained by the pocket and wherein the bottom of the pocket is located above a fastening section of the first shelf label holder and above the shelf;

inserting a rigid base of a second shelf label holder into the open top of the pocket of the first shelf label holder and behind the at least one first printed sign, the second shelf label holder including a sign sleeve coupled to the rigid base by a flexure, wherein the sign sleeve is defined by a rigid main panel and a flexible flap joined to the rigid main panel by a joined bottom end; and rotating the sign sleeve of the second shelf label holder about the rigid base of the second shelf label holder using the flexure after the rigid base is inserted into the open top of the pocket of the first shelf label holder so as to access information printed on the at least one first printed sign.

8. The method of claim 7, further comprising inserting at least one second printed sign into the sign sleeve of the second shelf label holder before inserting the rigid base of the second shelf label holder into the open top of the pocket and behind the at least one first printed sign of the first shelf label holder or after inserting the rigid base of the second shelf label holder into the open top of the pocket and behind the at least one first printed sign of the first shelf label holder.

9. The method of claim 8, wherein inserting the at least one second printed sign into the sign sleeve of the second shelf label holder comprises rotating the flexible flap of the sign sleeve about the joined bottom end to insert the at least one second printed sign into the sign sleeve of the second shelf label holder.

10. A shelf assembly comprising:

a first shelf label holder including a fastening section that fastens to a front of a shelf and a transparent pocket having a front, a back, a bottom and an open top, wherein the bottom of the pocket is located above the fastening section of the first shelf label holder and above the shelf; and a second shelf label holder including a rigid base, a sign sleeve and a flexure connecting the rigid base to the sign sleeve of the second shelf label holder, wherein the rigid base extends from the flexure, terminates at an end and includes at least a first arcuate bend that is concave relative to a front surface of the rigid base and a second arcuate bend connected to the first arcuate bend and is convex relative to the front surface of the rigid base; and wherein the rigid base of the second shelf label holder is inserted through the open top of the pocket and held in the pocket of the first shelf label holder with the at least first and second arcuate bends.

11. The shelf assembly of claim 10, wherein the rigid base, the sign sleeve and the flexure hinge are integrally formed and comprise a single, continuous material.

12. The shelf assembly of claim 10, wherein the first arcuate bend and the second arcuate bend each comprise a radius of curvature r that are substantially the same.

13. The shelf assembly of claim 10, wherein the rigid base further comprises a third arcuate bend connected to the second arcuate bend that is concave relative to the front surface of the rigid base.

14. The shelf assembly of claim 13, wherein the rigid base further comprises a fourth arcuate bend connected to the third arcuate bend that is convex relative to the front surface of the rigid base.

15. The shelf assembly of claim 14, wheren the first arcuate bend, the second arcuate bend, the third arcuate bend and the fourth arcuate bend each comprise a radius of curvature r that are substantially the same.

16. The shelf assembly of claim 10, further comprising at least one first printed sign positioned in the pocket.

17. The shelf assembly of claim 16, wherein the rigid base of the second shelf label holder is further inserted through the open top of the pocket of the first shelf label holder and positioned behind the at least one first printed sign.

18. The shelf assembly of claim 17, wherein the flexure allows the sign sleeve to rotate about the rigid base to access information on the at least one first printed sign.

19. The shelf assembly of claim 10, wherein the sign sleeve of the second shelf label holder is defined by a rigid main panel and a flexible flap joined to the rigid main panel by a joined bottom end.

20. The shelf assembly of claim 19, further comprising a second printed sign located in the sign sleeve of the second shelf label holder.

* * * * *